US005700174A

United States Patent [19]

Churchill et al.

[11] Patent Number: 5,700,174

[45] Date of Patent: Dec. 23, 1997

[54] KNEEBOARD

[75] Inventors: Robert Lee Churchill, Redlands; Douglas Geller, Arcadia, both of Calif.

[73] Assignee: Swimways Corporation, Virginia Beach, Va.

[21] Appl. No.: 710,583

[22] Filed: Sep. 19, 1996

[51] Int. Cl.[6] ..... B63B 35/81

[52] U.S. Cl. ..... 441/65; 441/72

[58] Field of Search ..... 441/65, 68, 74, 441/75

[56] References Cited

U.S. PATENT DOCUMENTS

| | | | |
|---|---|---|---|
| D. 290,151 | 6/1987 | Cashmere . | |
| 4,028,761 | 6/1977 | Taylor | 441/65 |
| 4,106,143 | 8/1978 | Lucas . | |
| 4,331,340 | 5/1982 | Bolen | 441/65 |
| 4,353,573 | 10/1982 | Morgan . | |
| 4,561,664 | 12/1985 | Cashmere . | |
| 4,603,870 | 8/1986 | Monreal . | |
| 4,619,619 | 10/1986 | Muse, Jr. . | |
| 4,669,992 | 6/1987 | Morris | 441/65 |
| 4,720,280 | 1/1988 | Hufnagl . | |
| 4,753,836 | 6/1988 | Mizell . | |
| 4,857,025 | 8/1989 | Brown et al. | 441/65 |
| 4,872,861 | 10/1989 | Gaudin . | |
| 4,883,436 | 11/1989 | Oakland | 441/65 |
| 5,114,370 | 5/1992 | Moran . | |
| 5,145,430 | 9/1992 | Keys . | |
| 5,167,552 | 12/1992 | Johnson, III . | |
| 5,247,898 | 9/1993 | Thornlimb . | |
| 5,257,953 | 11/1993 | Gillis . | |
| 5,275,860 | 1/1994 | D'Luzansky . | |

*Primary Examiner*—Jesus D. Sotelo
*Attorney, Agent, or Firm*—John F. Carroll, IV

[57] ABSTRACT

The improved watersports board includes an outer shell that is filled with a rigid foam core. The outer shell includes a hull and a deck connected by a lip. The deck includes an integrated passenger contact area which in turn includes a strengthener for resisting bending, shear and fatigue stresses. The strengthener forms contours within the passenger contact area and allows the lip to be of less thickness than the average thickness of the passenger contact area over the hull. In addition to the above features, the device may also include optional flexible foam padding attached to the passenger contact area and an optional kneestrap attached to the shell to provide increased maneuverability and comfort.

9 Claims, 4 Drawing Sheets

KNEEBOARD

BACKGROUND

The present invention relates to improved watersports boards commonly known as kneeboards. More particularly, the present invention concerns an integrated structural improvement to a kneeboard that minimizes thickness and increases structural strength and durability, thus increasing the useable life of the device as well as its maneuverability and performance.

A kneeboard is a recreational vehicle typically ridden by a single, kneeling passenger, who holds a line that is towed behind a motorized water craft. Kneeboards are typically manufactured using a rotational-molding process to create a rigid polymeric shell that is then filled with a rigid-curing, closed-cell foam. To increase the comfort of a kneeling rider, a flexible foam pad is often attached to the rear dorsal surface of a kneeboard, and often the rear dorsal surface of the polymeric shell of a kneeboard is contoured so as to conform to the profile of the lower legs of its rider. However, in order to withstand the bending, shear and fatigue stresses that kneeboards tolerate while under tow, these recreational devices are typically several inches thick, particularly those kneeboards with leg profile contouring.

Kneeboards are subject to repeated moments applied to both their front and rear portions while under tow and during acrobatic maneuvers commonly performed with the devices. Additionally, forces caused by the weight of a kneeboard rider combined with the force transmitted by the watercraft towing the kneeboard through the water impinge downward on the dorsal surface of the board. These forces are countered by drag and the inertial resistances of the body of water through which the vehicle travels. In thin, rotationally-molded watersports boards, these bending and shear forces, and their cycling, cause a combination of ultimate and fatigue failure in both the rigid, closed-cell foam and in the polymeric outer shell. The location of structural failure in these structures is typically laterally transverse to the ventral surface of the board.

In an unconstrained beam, susceptibility to shear stress failure and bending stress failure is inversely proportional to the moment of inertia of a beam, which in turn is directly proportional to beam height. Additionally, a relatively uniform, unconstrained beam with loading slightly off-center typically exhibits its greatest deflection at or near the point of loading. Such a beam's deflection is also inversely proportional to its moment of inertia, which is in turn directly proportional to beam height. Therefore, one manner of increasing resistance to bending, shear failure and deflection in a beam is to increase a beam's moment of inertia by increasing the average beam height. Another manner of increasing the structural integrity of such an device is to select materials that have greater ultimate stress limits.

By use of this latter manner, the state of the art of watersport board design was modified in the recent past with the advent of new materials and manufacturing processes. In particular, kneeboards constructed of compression-molded fiberglass in a polymeric matrix have shown characteristics of rigidity and durability that were at that time unknown in the art of kneeboard construction. However, the labor required by the compression-molding technique and the materials used therein are typically more expensive than those used in the rotational-molding process. Therefore, in order to remain competitive with the relatively inexpensive production and material costs associated with rotationally-molded boards, the compression-molded boards have been manufactured so as to minimize their thickness.

These relatively thin compression-molded boards provide kneeboard enthusiasts with performance enhancements over the relatively thick, rotationally-molded boards that are common in the industry. The fiberglass boards are less flexible and therefore more maneuverable than rotationally-molded boards. Also, because the fiberglass boards have an edge profile that is thinner than the relatively thick rotationally-molded boards, the fiberglass boards have increased turning performance. However, despite the benefits obtained by the compression-molded fiberglass boards, the thick, rotationally-molded boards have retained their popularity due to their relatively low cost. Rotationally-molded boards are also favored because compression-molded fiberglass boards are typically heavier and thus potentially more difficult to transport and store than rotationally-molded boards.

In an effort to provide the public with a lightweight kneeboard that is both affordable and highly maneuverable, attempts have been made to produce thin rotationally-molded kneeboards with the performance characteristics of compression-molded fiberglass boards. However, thin rotationally-molded boards generally suffer from several defects. Thin rotationally-molded boards have a very short life span because they lack rigidity and durability and thus quickly succumb to ultimate bending, shear and fatigue stresses. Also, thin rotationally-molded boards do not maneuver as responsively as thick, rotationally-molded boards because thin boards exhibit flexure which is substantially unseen in thick rotationally-molded boards and even less common in fiberglass boards.

For the foregoing reasons, there is a need for a kneeboard that has the affordability and reduced mass of rotationally-molded boards and the maneuverability, rigidity and durability of compression-molded boards.

SUMMARY

The invention is directed to a kneeboard that satisfies the aforementioned needs, having core surrounded by an outer shell. The shell forms a hull and a deck joined together by a lip, and the deck has a passenger contact area. Means for strengthening the board are integrated into the passenger contact area to form contours within the passenger contact area, and the average thickness of the device throughout the strengthening means is greater than the thickness of the lip.

BRIEF DESCRIPTION OF THE DRAWINGS

A preferred embodiment of the present invention will be described in greater detail with reference to the accompanying drawings, wherein like elements bear like reference numerals and where.

DESCRIPTION

Figure 1:
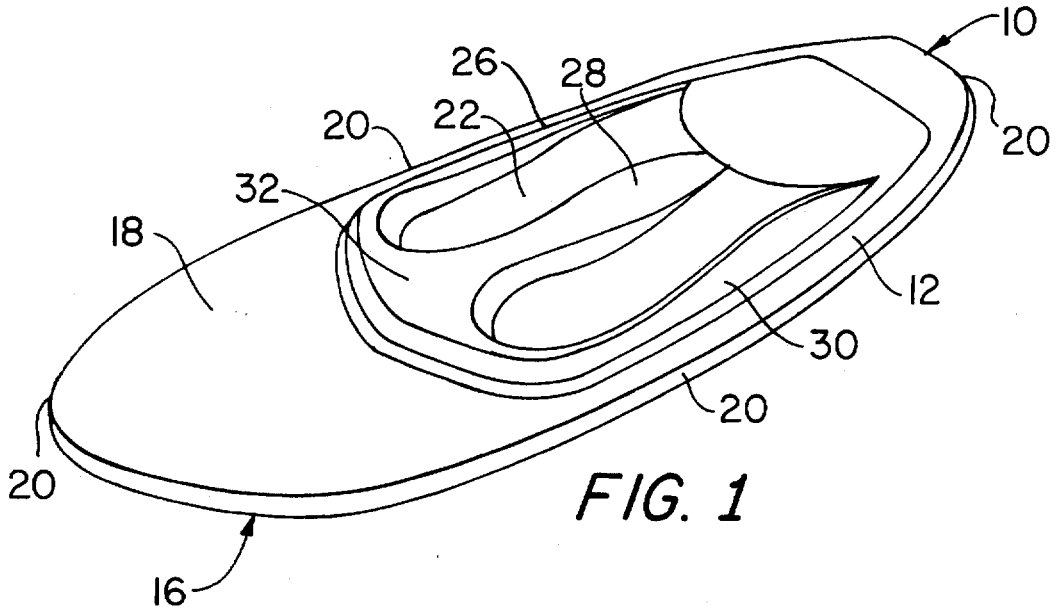
FIG. 1 shows a front-right perspective view of the kneeboard according to a first embodiment of the present invention.
Figure 2:
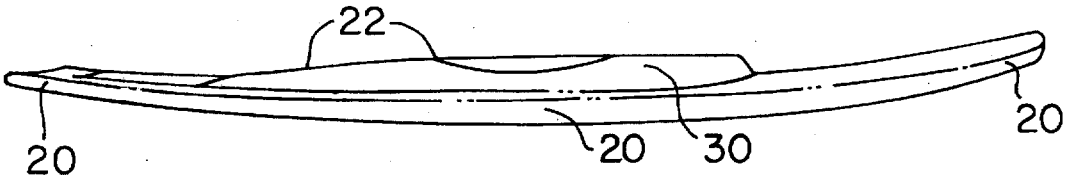
FIG. 2 shows left side elevation of the kneeboard of FIG. 1.
Figure 3:
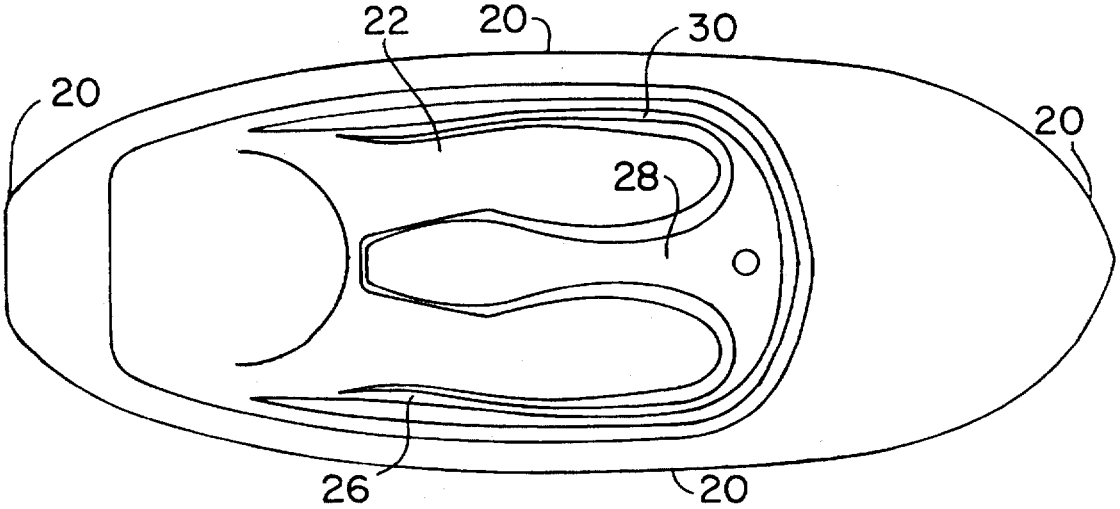
FIG. 3 shows a top plan view of the kneeboard of FIG. 1.
Figure 6:
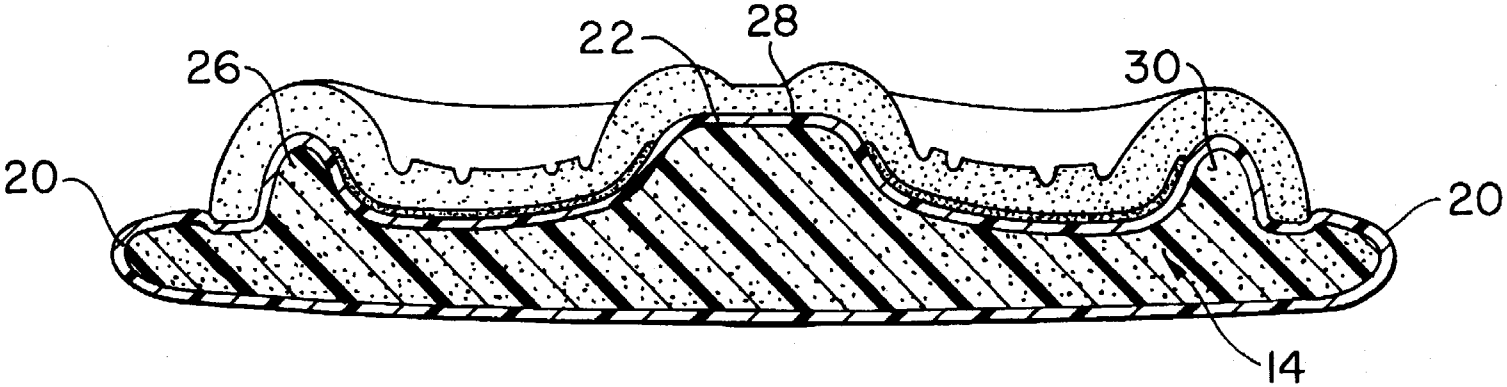
FIG. 6 shows a cross-sectional view of the kneeboard of FIG. 4, taken along the sectional line 6—6 of that figure.
Figure 7:
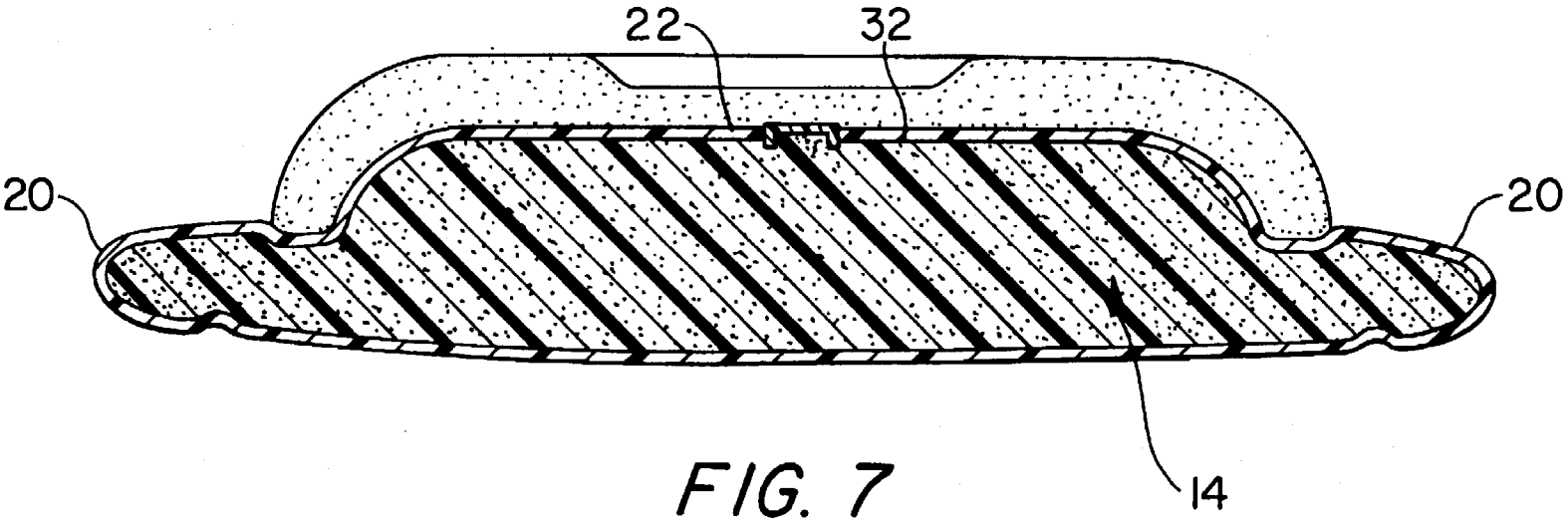
FIG. 7 shows a cross-sectional view of the kneeboard of FIG. 5 taken along the sectional line 7—7 of that figure.

With reference next to the drawings, FIG. 1 shows a kneeboard 10 embodying principles of the invention. The improved kneeboard 10 includes a shell 12, preferably of polymeric material, surrounding a core 14, preferably of rigid-curing, closed-cell foam material, which is best shown in FIGS. 6–7.

As best shown in FIGS. 1–3 and 5, the ventral surface of the shell 12 includes a hull 16 and the dorsal surface of the shell 12 includes deck 18. A lip 20 is integrated along the perimeter of the shell, joining the hull 16 to the deck 18. The deck 18 includes an integrated passenger contact area 22, and at least one vent hole 24 is formed in the passenger contact area which allows access to the interior of the shell. The shell 12 can be made from a rotational-molding process. The core 14 can be formed by filling the space formed by the interior of the shell 12 with uncured foam through the vent hole 24 that is then cured to form closed-cell, rigid foam.

The passenger contact area 22 assists in providing the device with resistance to bending, shear and fatigue stresses. As best shown in FIGS. 1–3 and 6–7, structural integrity is maintained in the device 10 by strategic provision of integrated support members 26, 28, 30, 32 throughout the passenger contact area. Specifically, the passenger contact area 22 includes a first support member 26, a second support member 30, a middle support member 28 and a transverse support member 32.

The first support member 26, the second support member 30, and the middle support member 28 are longitudinally integrated within the passenger contact area 22. The transverse support member 32 is integrated latitudinally across the passenger contact area Additionally, the first lateral support member 26, the middle lateral support member 28 and the second lateral support member 30 are each integrated with the transverse support member 32.

As best seen in FIG. 6 and FIG. 7, the first support member 26, the second support member 30, the middle support member 28 and the transverse support member 32 each have height greater than any point along the lip 20 of the device. These structural members are integrated within the passenger contact area 22 because the region from afore the center of the board to aft of the area on which the passenger rides is required to tolerate the greatest stresses. The lateral transverse support member 32 is integrated within the passenger contact region 22 in an extremely stress intolerant region of the device: at a point at which the passenger's knees make contact with the device, proximate to the center of the device. The lateral positioning of the transverse support member 32 at this location gives the device 10 a significantly greater average cross-sectional beam height, and therefore greater moment of inertia, than if the device 10 had uniform thickness equal to 10 the thickness of the lip 20 in this region.

The first support member 26, the middle support member 28 and the second support member 30 are integrated into the passenger contact area 22 in a substantially parallel manner so as to provide contouring for the legs of a passenger. The first support member 26 is integrated along one longitudinal side of passenger contact area 22, the second support member 30 is integrated along the longitudinal side of the passenger contact area 22 opposite of the first support member 26, and the middle support member 28 is integrated proximately along the longitudinal center of the passenger contact area 22. These three support members, the first support member 26, the middle support member 28 and the second support member 30, are each thicker than the lip 20 of the device 10 in that region. Specifically, as best shown in FIG. 6, the greatest thickness of the transverse support member 32 is greater than the greatest thickness of the lip 20. As best shown in FIG. 6, the greatest thickness of the first lateral support member the second lateral support member 30 and the middle lateral support member 28 are each greater than the greatest thickness of the lip 20 in that region.

These support members 26, 28, 30, 32 give the device 10 an average cross-section beam height and a moment of inertia greater than if the device 10 had a uniform thickness equal to the thickness of the lip 20. Therefore, taking into account their contribution to the moment of inertial of the device in the critical passenger contact region, these support members 26, 28, 30, 32, the transverse support member 32, the first support member 26, the middle support member 28 and the second support member increase the board's 10 resistance to bending and shear stress. Most importantly, however, this critical strengthening construction design does not interfere with the very narrow lip profile 20 required for maximizing maneuverability of the device 10.

Figure 4:
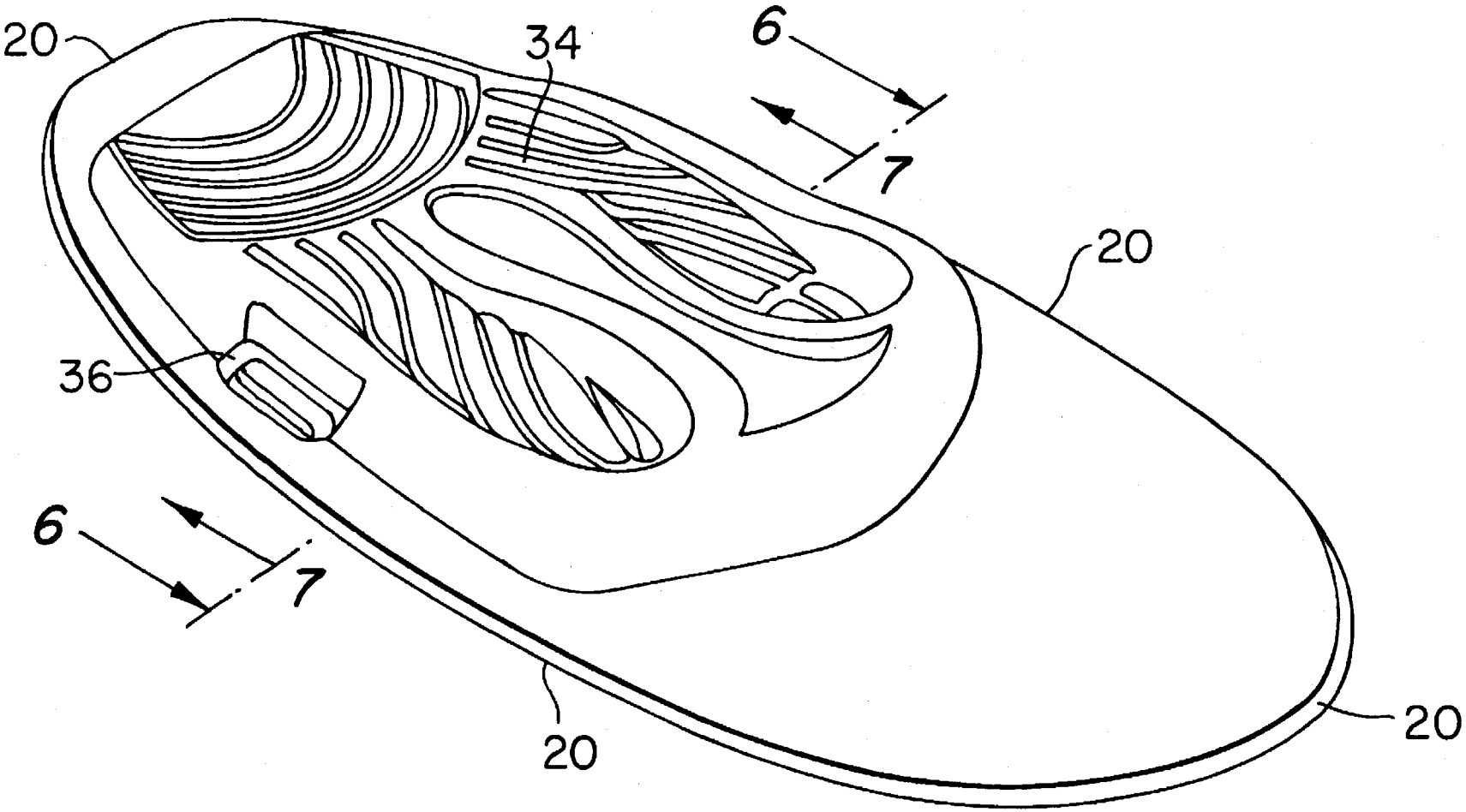
FIG. 4 shows a front-left perspective view of the kneeboard of according to a second embodiment of the present invention.

As shown in FIG. 4 and FIGS. 6–7, the device can also include a flexible pad 34 attached to the passenger contact area 22. The flexible pad 34 can have a coefficient of friction greater than that of the polymeric, rotationally-molded shell 12 such that a passenger can more easily maneuver the device 10 than without the pad 34. The flexible pad 34 also provides comfort to a kneeling passenger.

Additionally, the device can also include a kneestrap having two ends, with each end of the strap attached to a kneestrap anchor 36, one of which are connected to each side of the shell 12. The kneestrap is placed over the upper legs of a passenger, kneeling on the device 10 and assists in control and maneuverability.

It thus is seen that kneeboards can be made using a rotational-molding technique and provided with a thin lip and rigidity necessary for maneuverability in a manner such that durability is not compromised. It should be understood that the described embodiments merely illustrate principles of the invention in preferred forms. Many modifications, additions and deletions may be made without departure from the description provided.

What is claimed is:

1. A kneeboard comprising:

(a) a core having a dorsal and a ventral surface; and (b) a shell surrounding the core, said shell comprising:

i. a hull adjoining the ventral surface of the core, said hull having a ventral surface;

ii. a deck adjoining the dorsal surface of the core; said deck comprising a passenger contact area; the passenger contact area having a first lateral side, a middle lateral area, a second lateral side, a front transverse portion, and a most dorsal portion; the passenger contact area comprising means for strengthening integrated into the passenger contact area, said strengthening means forming a plurality of contours in the passenger contact area; and iii. a lip connecting the hull to the deck, said lip having a dorsal surface and a ventral surface; wherein the thickness between the dorsal surface of the lip and the ventral surface of the lip is less than the average thickness of the shell measured between the dorsal portion of the passenger contact area and the ventral surface of the hull.

2. A kneeboard as recited in claim 1 further comprising a flexible pad attached to the passenger contact area.

3. A kneeboard as recited in claim 1 further comprising a kneestrap attached to the shell.

4. A kneeboard as recited in claim 1 wherein the strengthening means comprises:

(a) a first lateral support member integrated along the first lateral side of the passenger contact area;

(b) a middle lateral support member integrated along the middle lateral area of the passenger contact area, (c) a second lateral support member integrated along the second lateral side of the passenger contact area; and (d) a transverse support member integrated along the front transverse portion of the passenger contact area, said transverse support member also integrated with the first lateral support member, the middle lateral support member, and the second lateral support member; the integration of said first lateral support member, said middle lateral support member, said second lateral support member and said transverse support member forming two parallel contours in the passenger contact area.

5. A kneeboard as recited in claim 4 further comprising a flexible pad attached to the passenger contact area.

6. A kneeboard board as recited in claim 4 further comprising a kneestrap attached to the shell.

7. A kneeboard comprising:

(a) a hull;

(c) a lip attached to the hull; and (b) a deck attached to the lip forming an enclosure within the hull, the lip and the deck; said deck comprising a passenger contact area; said passenger contact area having a first lateral side, a second lateral side, a middle lateral area and a front transverse portion; the passenger contact area comprising:

i. a first lateral support member integrated along the first lateral side of the passenger contact area;

ii. a second lateral support member integrated along the second lateral side of the passenger contact area, iii. a middle lateral support member integrated along the middle lateral area of the passenger contact area; and iv. a transverse support member integrated along the front lateral portion of the passenger contact area; said transverse support member also integrated with the first lateral support member, the second lateral support member, and the middle lateral support member in such a manner as to form two parallel contours in the passenger contact area;

(d) a core of size adequate to fill the hollow enclosure formed between the hull, the lip and the deck, said core secured within the enclosure formed between the hull, the lip and the deck.

8. A kneeboard as recited in claim 7 further comprising a flexible pad attached to the passenger contact area.

9. A kneeboard as recited in claim 7 further comprising a kneestrap attached to the shell.

* * * * *

UNITED STATES PATENT AND TRADEMARK OFFICE

CERTIFICATE OF CORRECTION

Figure 5:
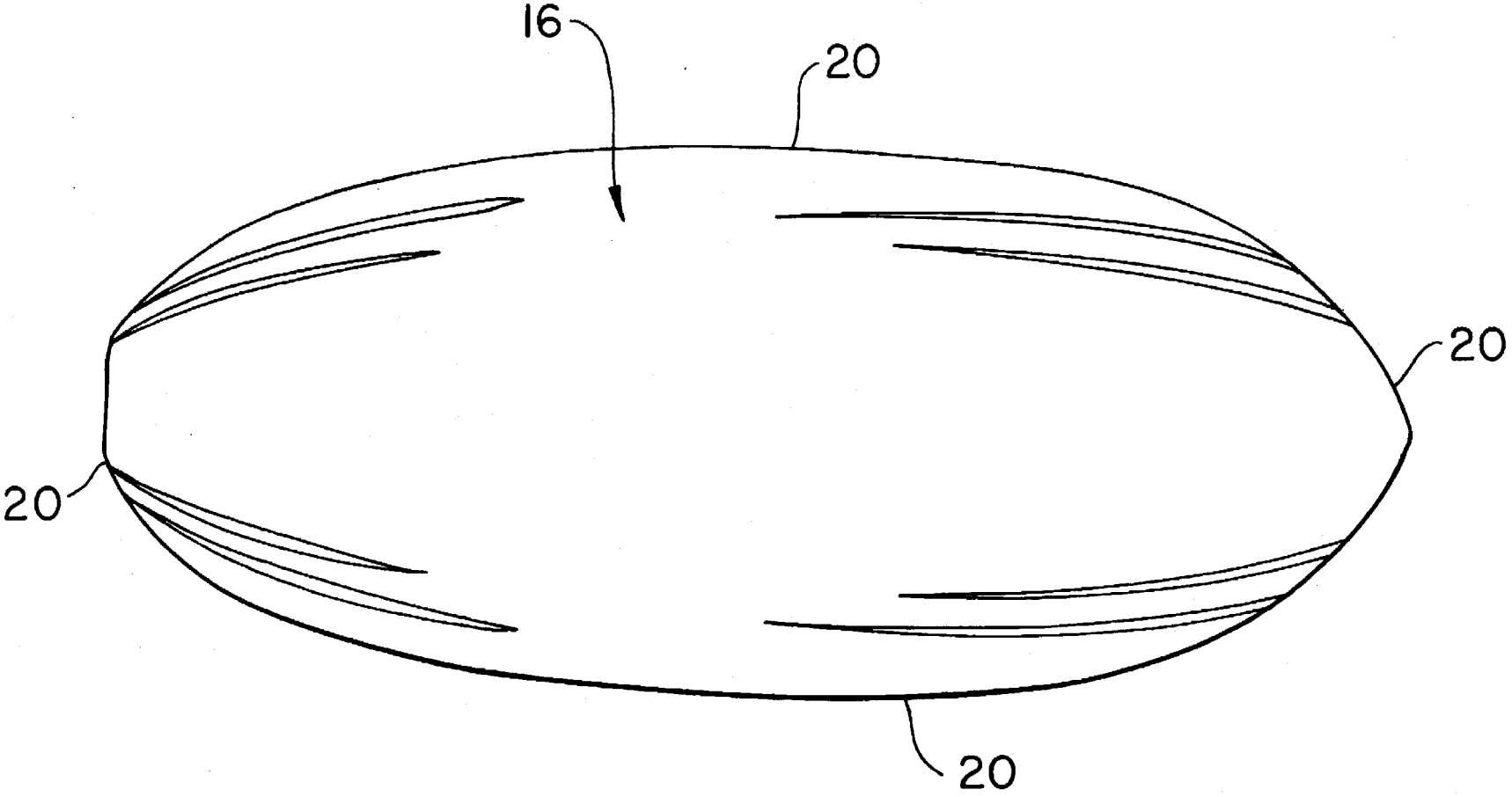
FIG. 5 shows a bottom plan view of the kneeboard of FIG. 4.

PATENT NO. : 5,700,174
DATED : December 23, 1997
INVENTOR(S) : Robert Lee Churchill and Douglas Geller It is certified that error appears in the above-identified patent and that said Letters Patent is hereby corrected as shown below:

At column 2, line 67, "FIG. 5" should be --FIG. 4--.

only FIG. 4 shows the section referred to in that description.

At column 3, line 20, please insert --10-- after "device".

At column 3, line 24, please insert --22-- after "area".

At column 3, line 32, please insert --22.-- after "area".

At column 3, line 53, please delete "10" after "equal to".

At column 4, line 5, please insert --26,--

UNITED STATES PATENT AND TRADEMARK OFFICE

CERTIFICATE OF CORRECTION

PATENT NO. : 5,700,174
DATED : December 23, 1997
INVENTOR(S) : Robert Lee Churchill and Douglas Geller It is certified that error appears in the above-identified patent and that said Letters Patent is hereby corrected as shown below:

At column 4, line 16, please insert --30,-- after "member".

At column 5, line 25, "(c)" should be --(b)--.

At column 5, line 26, "(b)" should be --(c)--.

Signed and Sealed this

First Day of December, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT : 5,700,174

DATED : December 23, 1997

INVENTOR(S) : Robert Lee Churchill and Douglas Geller

It is certified that error appears in the above-identified patent and that said Letters Patent is hereby corrected as shown below:

At column 2, line 67, "FIG. 5" should be --FIG. 4--.

At column 3, line 20, please insert --10-- after "device'.

At column 3, line 24, please insert --22-- after "area".

At column 3, line 32, please insert --22.-- after "area".

At column 3, line 53, please delete "10" after "equal to".

At column 4, line 5, please insert --26,-- after "member" and before "the".

UNITED STATES PATENT AND TRADEMARK OFFICE

CERTIFICATE OF CORRECTION

PATENT : 5,700,174

DATED : December 23, 1997

INVENTOR(S) : Robert Lee Churchill and Douglas Geller

It is certified that error appears in the above-identified patent and that said Letters Patent is hereby corrected as shown below:

At column 4, line 16, please insert --30,-- after "member".

At column 5, line 25, "(c)" should be --(b)--.

At column 5, line 26, "(b)" should be --(c)--.

At column 6, line 13, "lateral" should be --transverse--.

This certificate supersedes Certificate of Correction issued December 1, 1998.

Signed and Sealed this

Eighteenth Day of May, 1999

*Attest:*

Q. TODD DICKINSON

*Attesting Officer*

*Acting Commissioner of Patents and Trademarks*